United States Patent [19]

Itaya et al.

[11] Patent Number: 4,530,595

[45] Date of Patent: Jul. 23, 1985

[54] TONER CLEANING METHOD AND APPARATUS IN WHICH VOLTAGE IS IMPRESSED BETWEEN ELECTROSTATIC IMAGE HOLDER AND A FILM MEMBER

[75] Inventors: Masahiko Itaya; Satoshi Haneda; Noriyoshi Tarumi, all of Hachioji; Makoto Tomono, Hino, all of Japan

[73] Assignee: Konishiroku Photo Industry Co., Ltd., Tokyo, Japan

[21] Appl. No.: 407,920

[22] Filed: Aug. 13, 1982

[30] Foreign Application Priority Data

Aug. 24, 1981 [JP] Japan ..... 56-133201

[51] Int. Cl.[3] ..... G03G 21/00

[52] U.S. Cl. ..... 355/15; 355/77; 430/125; 118/652

[58] Field of Search ..... 355/15, 3 R, 3 TR, 77; 15/1.5; 430/125; 118/652

[56] References Cited

U.S. PATENT DOCUMENTS

| | | | |
|---|---|---|---|
| 2,990,278 | 6/1961 | Carlson | 355/3 TR |
| 3,404,418 | 10/1968 | Fantuzzo | 15/1.5 |
| 3,950,089 | 4/1976 | Fraser et al. | 355/15 X |
| 4,252,433 | 2/1981 | Sullivan | 355/15 |

FOREIGN PATENT DOCUMENTS

| | | | |
|---|---|---|---|
| 2645379 | 11/1978 | Fed. Rep. of Germany | 355/15 |
| 2555854 | 8/1982 | Fed. Rep. of Germany | 355/15 |
| 2016409 | 5/1970 | France | 355/15 |

OTHER PUBLICATIONS

Patents Abstracts of Japan, E-158, Dec. 11, 1979, vol. 3/No. 150, (Kokai No. 54-131940).

Patents Abstracts of Japan P-21, Jul. 31, 1980, vol. 4/No. 107, (55-64272 (A)).

*Primary Examiner*—R. L. Moses

*Attorney, Agent, or Firm*—Frishauf, Holtz, Goodman & Woodward

[57] ABSTRACT

A method and apparatus for cleaning toner from the surface of an electrostatic image holder wherein a film member comprising superposed insulating and conductive layers is positioned close to an electrostatic image holder so that the insulating layer of the film member faces the image holder. At least one of a d.c. voltage and an a.c. voltage is applied between the electrostatic image holder and the film member, the toner from the surface of the electrostatic image holder being removed and transferred onto the surface of the insulating layer of the film member. The toner from the surface of the insulating layer of the film member may be removed by a removing means. Also, an electrostatic charge eliminator is provided for eliminating the electrostatic charge from the surface of the insulating layer after removal of the toner therefrom.

26 Claims, 11 Drawing Figures

(a)

(b)

TONER CLEANING METHOD AND APPARATUS IN WHICH VOLTAGE IS IMPRESSED BETWEEN ELECTROSTATIC IMAGE HOLDER AND A FILM MEMBER

BACKGROUND OF THE INVENTION

1. Field of the Invention

The present invention relates to a developer cleaning method and an apparatus for cleaning the surface of an electrostatic image holder of an electrostatic recording apparatus such as a dry type electrophotographic copying apparatus or the like wherein a visible image is formed by the dry type development and said image is transferred and a copy is obtained.

2. Description of the Prior Art

Typical cleaning apparatus for the electrostatic image holder used in a dry type electrophotographic copying apparatus includes a type wherein the cleaning is carried out by rubbing the surface of the electrostatic image holder using a member such as a blade, a fur brush or a web, a type wherein an air stream is used for the cleaning and a type wherein a magnetic force or a magnetic brush etc. is used for the cleaning.

A cleaning apparatus of the type wherein the surface of the electrostatic image holder is rubbed has tended to hurt the surface of said image holder and thereby has been unsuitable especially for an image holder with a weak surface strength such as an organic photoconductive receptor. A cleaning apparatus of the type wherein an air stream is used has had problems in that the apparatus itself tends to be large and noise is produced and the recovered efficiency of toner powder is lowered. Further, in the cleaning apparatus wherein a magnetic brush is used, said apparatus itself has been expensive and the cleaning ability has been inferior.

SUMMARY OF THE INVENTION

The present invention provides a cleaning method for collecting toner in the reusable state without hurting the surface of the electrostatic image holder wherein a high cleaning ability is available and no toner filming on the surface of the holder occurs. A developer-cleaning method of the invention is characterized in that an insulating surface of a film member whose one side is electrically conductive and the other side is insulated is positioned closely against an electrostatic image holder of an electrostatic recording apparatus and there exists a process wherein a direct current voltage and/or an alternating current voltage whose polarity is opposite to that of residual developer on the electrostatic image holder is impressed between said electrostatic image holder and the film member and thereby the residual developer grains are separated from said electrostatic image holder and are transferred to said film member. A developer-cleaning apparatus per se comprises a film member whose one side is electrically conductive and the other side is insulated, a film member holding means to hold the insulated surface of said film member closely gainst the electrostatic image holder of the electrostatic recording apparatus, an electrode member to impress the voltage on the electrically conductive surface of said film member, a voltage-impressing means to impress a directed current voltage and/or an alternating current voltage between said electrode member and said electrostatic image holder and a removing means to remove the developer adhered on the insulating surface of said film member.

The basic technical feature of the present invention is to clean by transferring toner on the surface of the electrostatic image holder electrostatically onto an insulating film and a principal point of the present invention is to offer, in a way to overcome the problems for actual usage, the cleaning method and cleaning apparatus wherein a film member in which the back side of said insulating film is treated with a conductive layer held closely to the surface of the electrostatic image holder to be cleaned and toner is transferred electrostatically from the electrostatic image holder to the insulating side of the insulating film.

DETAILED DESCRIPTION OF THE PREFERRED EMBODIMENTS

Figure 1:
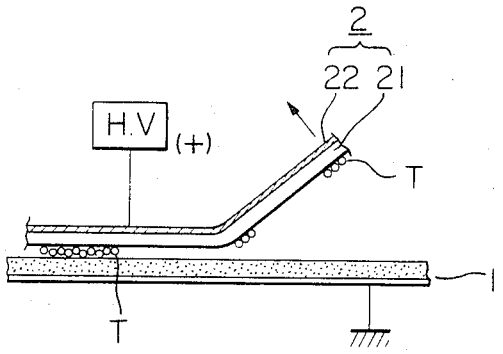
FIG. 1 is a sectional view showing the principle of the present invention.

FIG. 1 is a sectional view illustrating the principle of the present invention. Toner T adhered on the surface of an electrostatic image holder (an image holder) 1 is separated from said image holder 1 by impressing a high voltage H.V on a conductive layer 22 of a belt shaped film 2 which comprises essentially an insulating film 21 and the conductive layer 22 that is on a back side of said film 2, and thus the surface of the image holder 1 is cleaned. In this case, the toner T needs to be charged or to be strong in polarizing nature, and the polarity of the voltage to be impressed on the conductive layer 22 needs to be opposite to the polarity of the toner T.

Figure 2:
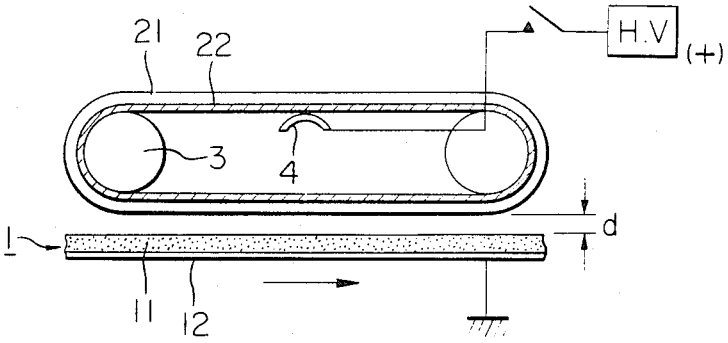
FIGS. 2(*a*) and 2(*b*) are sectional views showing the clearance between an electrostatic image holder and a cleaning belt.
Figure 2:
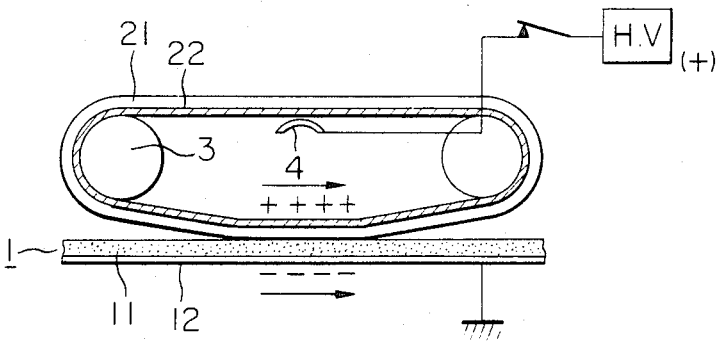

A basis of the cleaning apparatus of the present invention is that the film 2 is positioned closely against the image holder 1 and due to high voltage H.V to be impressed, said film 2 is electrically attracted to said image holder 1 and touches the image holder 1. As the image holder 1 moves during the copying process, the film 2 also moves according to the movement of the imager holder 1. It was further necessary to solve the problem of the voltage to be impressed for transferring, the problem of collecting of the transferred toner and the problem of a film material and others in order to accomplish the present invention. Each item will be explained as follows. (1) Holding and conveying of the belt Referring to FIGS. 2(*a*) and 2(*b*), an endless belt comprising essentially an insulating film 21 having a thickness $t_2$ and a conductive layer 22 provided inside thereof is held with a plurality of rollers 3 so that said insulating film 21 faces the image holder 1 with a distance of d therebetween as shown in FIG. 2(*a*). The arrangement is such that the image holder 1 and the endless belt contact each other owing to the electrostatic force when the high voltage H.V is impressed on the conductive layer 22 through a contact shoe 4 as a voltage supply means, as shown in FIG. 2(*b*). Namely, in order for the endless belt to be attracted or separated from the image holder 1 due to the ON-OFF of the high voltage H.V., the following conditions need to be satisfied:

$$\left.\begin{aligned} F < \frac{\partial U}{\partial d'} = \frac{V^2}{2} \cdot \frac{\partial c}{\partial d'} = \frac{V^2 \epsilon OS}{2d'^2} \\ d' = \frac{t_1}{\epsilon_1} + d + \frac{t_2}{\epsilon_2} \end{aligned}\right\} \quad (1)$$

where,

V: voltage to be impressed

S: area facing the image holder $t_1$: thickness of an image holder $\epsilon_1$: dielectric constant of said image holder $t_2$: thickness of an insulating film $\epsilon_2$: dielectric constant of said insulating film d: distance between an image holder and an insulating film F: tensile force in the insulating film in FIG. 2(*b*)

As is clear from the above formulas, the distance d is a function of the tensile force of the insulating film and of the voltage to be impressed and, at the same time, is related also to the constant physical properties of both the image holder and the insulating film.

When the voltage V is impressed, the insulating film sticks firmly to the image holder 1 with a force corresponding to that for d=0 of formula (1) and therefore said belt (21,22) is driven by the movement of the image holder 1. Therefore, in the apparatus of the present invention, it is not necessary to drive the insulating film (belt 21,22). Further, since the film sticks evenly and firmly with an electrostatic force, a specific device for pressing said film to the image holder side is not necessary and thereby the structure is extremely simple and the cost thereof is remarkably reduced. Rollers 3 in FIG. 2, on the other hand, are rotatable and are adjusted so that they are positioned close to the image holder keeping a certain clearance of d, by using a roller-shaped spacer that is larger than the roller diameter by a certain clearance and by pressing it toward the image holder 1.

(2) Voltage to be impressed

When peeling the insulating film (belt 21,22) off the image holder, a dielectric breakdown is seen at the clearance between the insulating film and the electrode of the image holder owing to the voltage between the insulating film and the electrode of the image holder. This may be known from the Paschen curve. However, when the image holder is not an insulator and is a photosensitive receptor or the like that is a resisting body having an electric field-dependence, the relation between the voltage to be impressed and a dielectric breakdown should be experimentally obtained. When actually transferring the toner, if the voltage to be impressed on the film is too high, the toner on the image holder, after being transferred to said film once, returns to the image holder side again. According to experiments wherein a selenium photosensitive receptor with a thickness of 50 μm are used and electric charges on the photosensitive receptor are eliminated after the selenium photosensitive receptor is charged positive and the development is made by the toner with a negative polarity and the insulating film is superposed for the impression of voltage, a voltage of about 700–800 V is a limit and with the voltage to be impressed that exceeds such limit, the perfect transferring of the toner is prevented by the discharge and the toner remains on the photosensitive receptor side. With a voltage of about 400 V or less, on the other hand, the transferring is not made sufficiently. In this case, the average toner had a particle diameter of 12 μm and had an electric charging of 15 μc/g. However, such value needs to be decided according to the environment and materials to be used because it is highly influenced by the temperature, humidity and atmospheric pressure and is decided by the resistance of the selenium photosensitive receptor and by the dielectric constant of the film.

(3) Collection of transferred toner

As stated above, when the resistance of a conductive layer on one side of an insulating film was lower and every portion of the endless belt had the same potential, it was difficult to sufficiently collect toner transferred onto said film.

Figure 3:
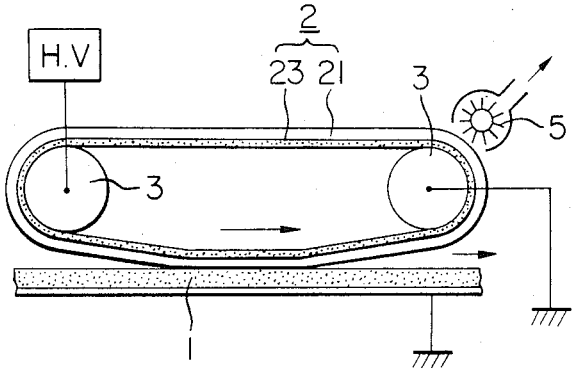
FIGS. 3, 4(*a*) and 4(*b*) show a first embodiment of the invention to remove toner on the cleaning belt.

In order to overcome this drawback, there was developed a system comprising, as shown in FIG. 3, an endless belt 2 comprising essentially an insulating film 21 and a resistance member 23 provided on the back thereof, and a voltage source impressing a voltage H.V on one of rollers 3 that hold said endless belt 2, the other roller 3 being grounded. The cleaning of recovered toner on the endless belt was performed by a cleaning device 5 provided near the grounded roller enabled said toner to be perfectly removed. The resistance member 23 may be an object with high resistance because there is no need to let much electric current flow therethrough. The resistance value of the resistance member is to be decided in due consideration of the capacity of a power source and generation of heat. The usage of a resistance member with a resistance value of about $10^6$ Ω.cm have a good result when a voltage of 1 KV was impressed in the device having the closest distance of roller 2 cm, a belt width of 30 cm and a thickness of resistance member of 50μ.

Figure 4:
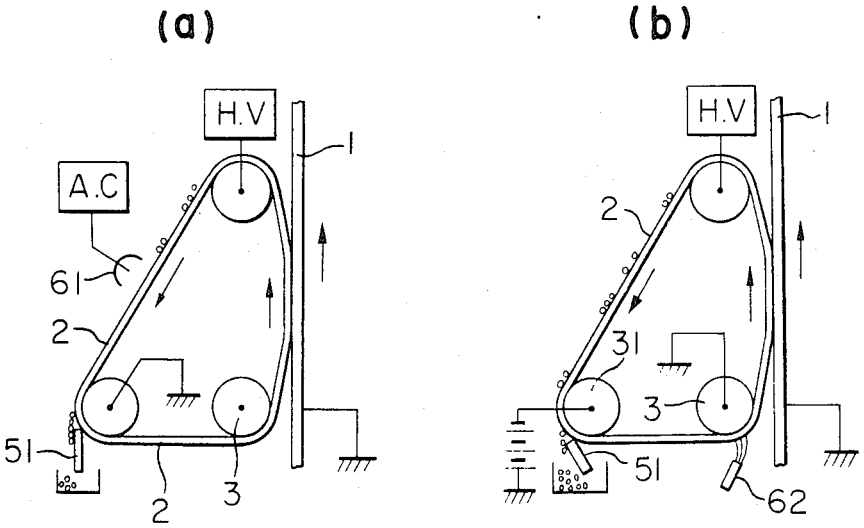

As a cleaning device (removing means) 5 for toner on the endless belt, a fur brush or a cleaning blade may be used. Because the insulating film 21 itself is electrically charged and the removal thereof is needed, the fur brush and the blade in this case are preferably electrically conductive. As an eliminating means for the eliminating of the surface charge of the insulating film 21, a corona discharger, a conductive blade or an eliminating brush etc. may be used. According to experiments, the toner removal by a combination of the conductive blade and an eliminating brush obtained a good result. Further, as shown in FIG. 4(*a*), it was effective to employ a method to eliminate charge entirely by an alternating current corona discharger 61 before removing the toner by a conductive blade 51. The conductive blade 51 may be grounded. The method shown in FIG. 4(*b*) also proved to be effective and the endless belt 2 therein was held by three rollers and on the roller 31 located at the place where a conductive blade 51 for removing toner was provided, a voltage (negative voltage in this example) that is the same as the toner in polarity was impressed. A charge eliminating brush 62 is also provided in the embodiment of FIG. 4(*b*).

(4) Material of a cleaning film

As an insulating film, most of the general high polymer films such as a polyethylene terephthalate and a polyimide are usable and a film with a high dielectric constant such as PVDF and the like is also suitable. Further, when a photoconductive film is used, the charge eliminating effect is good, though the durability thereof is inferior.

The conductive layer may be formed on the insulating film by methods such as evaporation, coating of conductive paints and laminating of aluminum foil, etc. Further, it is possible to give a certain resistance by coating urethane wherein carbon is mixed therein on the insulating film. Thereby, it was possible to prepare an endless belt comprised essentially of polyimide film with a thickness of 20μ and a resistance layer with a thickness of 50μ, which gave satisfactory results.

It is also important to give an appropriate tensile force to the endless belt. This may be accomplished by connecting a spring member to the holding roller in order to stretch said belt, or to manufacture a roller itself with a conductive and elastic substance. The degree of tension for the endless belt is decided by the above formulas (1) or by experimentation. If a conductive tension roller which is grounded is provided on the external surface of the endless belt, the adjustment of the belt is easy and the effect of charge eliminating is obtained.

Figure 5:
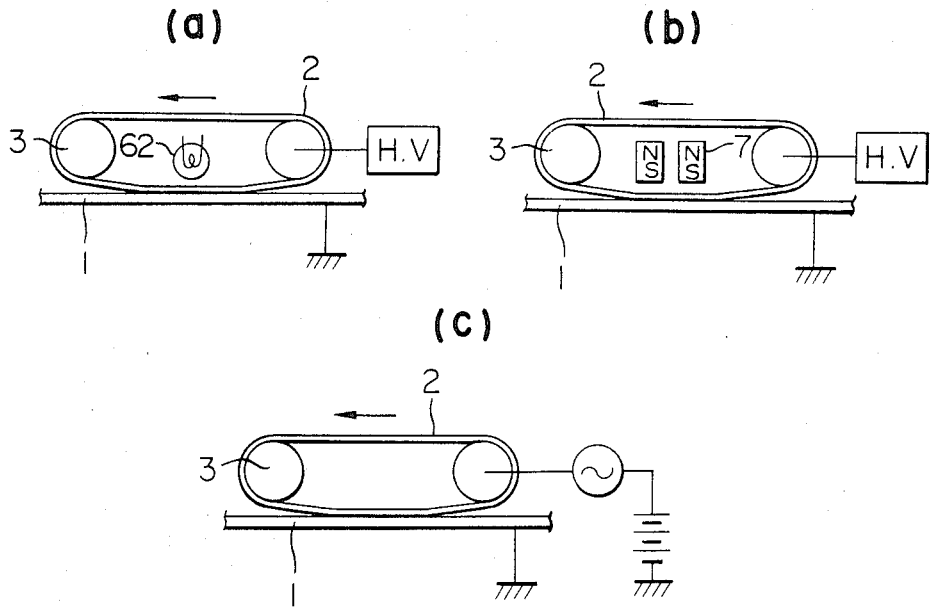
FIGS. 5(*a*)–5(*c*) show a second embodiment of the invention to increase the cleaning effect.

In addition to the mechanism and method explained above, it ws also found to be effective to provide a lamp 62 inside the belt 2 that is made of a transparent member or of a translucent member, as shown in FIG. 5(*a*), and to eliminate the charge on the photosensitive receptor.

When a one-component magnetic developer was used, it was effective to place magnets 7 inside the belt 2 that is made of non-magnetic material so that magnets 7 oppose the image holder 1, as shown in FIG. 5(*b*). Using this construction, a sufficient effect was observed for the prevention of developer repelling.

As shown in FIG. 5(*c*), it was possible to enhance the efficiency of transferring toner to the endless belt 2 by superposing an AC voltage on the DC voltage that is opposite to the toner in polarity as the voltage to be impressed on the endless belt 2.

Two examples which gave satisfactory results will now be explained.

EXAMPLE 1

Figure 6:
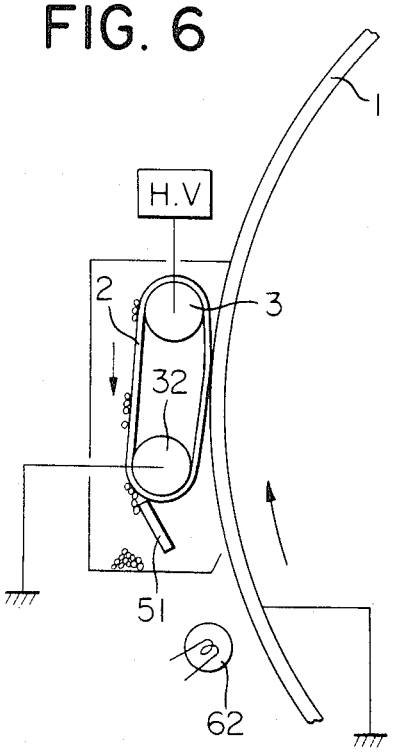
FIGS. 6 and 7 show sectional views showing the first and second embodiments of the present invention, respectively.

FIG. 6 shows a first example of the present invention. Numeral 1 is a photosensitive receptor drum comprising selenium and tellurium and having a thickness of 50–70μ as an electrostatic image holder. The photosensitive receptor drum 1 is rotated in the direction of an arrow at the linear speed of 150 mm/sec. Toner comprising a styrene-acrylate resin as the principal ingredients was charged in the negative polarity.

The surface charge of the photosensitive receptor drum 1 was elminated by a cleaning lamp 62 before cleaning said surface of the receptor drum. An endless belt 2 comprised essentially of a polyimide film as insulating film with a thickness of 20μ and a resistance layer with a thickness of 50μ comprised of an urethane rubber dispersed carbon mounted inside said polyimide film. The resistance thereof was about $10^{6-8}$ Ω.cm and the voltage H.V to be impressed on the endless belt 2 was +700 V.

A conductive blade 51 to remove the toner from the endless belt 2 was provided in the vicinity of a grounded roller 32.

With the above apparatus of the present invention, it was possible to obtain a satisfactory cleaning effect.

EXAMPLE 2

Figure 7:
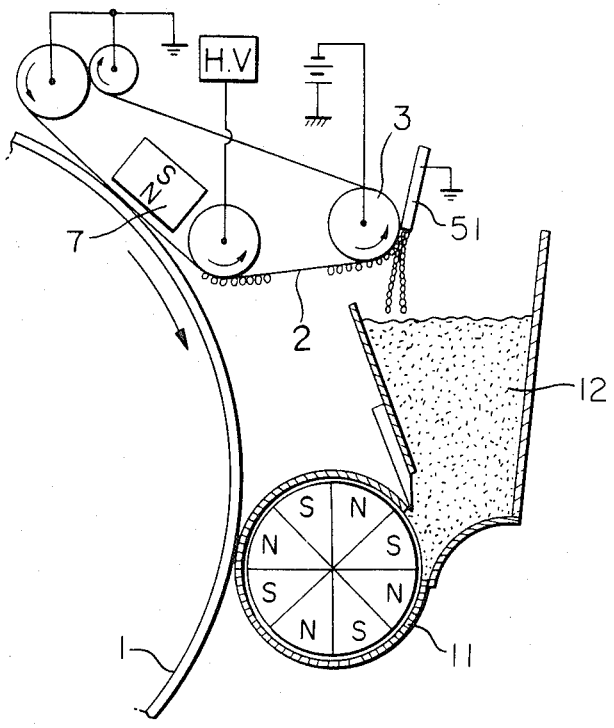

This is an example applied to a copying apparatus wherein a one-component magnetic developer was employed and it is shown in FIG. 7. In this system, two rotations of drum 1 complete one process. In the first rotation, development is made by a developing device 11 and in the second rotation, cleaning of the remaining toner is carried out.

In the arrangement of FIG. 7, a high voltage of 800 V was impressed and the endless belt 2 contacted the photosensitive receptor drum 1 only when cleaning was being carried out. In this case, the minimum distance between the belt 2 and the surface of the photosensitive receptor drum 1 is 0.5 mm when no voltage is impressed.

A conductive rubber wound around a steel shaft is used for all of the rollers 3. The endless belt and the photosensitive receptor drum used were the same as those in Example 1. At the contacting portion between the cleaning belt 2 and the photosensitive receptor drum 1, a magnet 7 was provided so that it opposes said photosensitive receptor drum 1.

In the present example, toner scraped off by the conductive blade 51 was dropped in a toner supply hopper 12, which had an effect to make the toner recycling easy.

The advantageous effects derived from the usage of the method and apparatus of the present invention are as follows:

(1) A cleaning member does not hurt or damage an image holder.
(2) Scattering of toner is slight.
(3) Setting of the position of the cleaning device is free.
(4) The contacting pressure of a cleaning member against an image holder is uniform and it may be easily controlled by the adjustment of the voltage to be impressed.
(5) It is possible to make the apparatus small and the usage of no power causes a decrease in cost.
(6) Toner filming on an image holder does not take place.

The present invention has been explained above by way of concrete examples. The present invention is not limited to the above examples.

What is claimed is:

1. A method for cleaning toner from the surface of a movable electrostatic image holder comprising the steps of:

providing a flexible endless belt-type film member formed of an insulating layer and a conductive layer inside said insulating layer and arranged so as to be rotatable;

positioning said film member so that it faces a surface of said electrostatic image holder;

selectively displacing at least a part of said endless film member from a first position whereat said film member is close to but out of contact with said electrostatic image holder, to a second position whereat said insulating layer of said film member is in contact with said surface of said electrostatic image holder;

applying a voltage between said electrostatic image holder and said conductive layer of said film member and, when said voltage is applied, displacing said film member to said second position, said applied voltage comprising at least a D.C. voltage whose polarity is opposite to that of toner on the toner on the surface of said electrostatic image holder; and transferring the toner from the surface of said image holder to said insulating layer of said film member under the influence of said applied voltage when said film member is at said second position.

2. The method of claim 1, further comprising removing said transferred toner from the surface of said insulating layer of said film member.

3. The method of claim 2, further comprising eliminating an electrostatic charge from the surface of said insulating layer after removing said transferred toner therefrom.

4. The method of claim 1, wherein said electrostatic image holder is movable, and wherein when said rotatable film member is at said second position in contact with said electrostatic image holder, said film member moves with said electrostatic image holder due to said contact, without requiring driving means for moving said film member.

5. The method of claim 1, further comprising magnet means positioned opposite said conductive layer of said film member opposite the area where said insulating layer of said film member faces said image holder.

6. The method of claim 1, further comprising applying tension to said film member, at least over the portion thereof which is positioned close to said electrostatic image holder.

7. The method of claim 1, wherein said film member is movable at substantially the same linear speed as said movable electrostatic image holder at least at the point of contact of said film member with said electrostatic image holder when said film member is at said second position.

8. The method of claim 1, wherein said applied voltage comprises a D.C. voltage with an A.C. voltage superposed thereon.

9. A developing and cleaning apparatus for a two-cycle electrophotographic copying apparatus having a rotatable drum-like electrostatic image holder in which during a first rotation of said image holder a toner-based copied image of an original is produced, and in which residual toner from the image holder is removed during a second rotation of said image holder to prepare the image holder for next succeeding coprying operation, the developing and cleaning apparatus comprising:

developing means for developing an electrostatic latent image on the surface of said electrostatic image holder, said developing means including:

a developing member for carrying and developing a developer; and a toner supply means for suplying toner to said developing member; and a toner cleaning apparatus comprising:

a flexible endless belt-type film member comprising an insulating layer and a conductive layer inside said insulating layer, said endless film member being rotatably mounted, said film member being positioned so that at least a part thereof faces a surface of said electrostatic image holder;

displacing means coupled to said film member for selectively displacing said film member from a first position whereat insulating layer of said film member is close to but spaced from and facing said electrostatic image holder to a second position whereat at least a surface portion of said insulating layer of said film member faces and is in contact with the surface of said electrostatic image holder;

voltage supply means including an electrode member coupled to said film member for applying a voltage between said electrostatic image holder and said conductive layer of said film member when said film member is at said second position, said applied voltage being a D.C. voltage whose polarity is opposite to that of toner on the surface of said electrostatic image holder;

said displacing means displacing said film member to said second position when said voltage is applied;

whereby toner from the surface of said image holder is transferred to said insulating layer under the influence of said applied voltage when said film member is at said second position; and removing means associated with said film member for removing toner adhering to the surface of said insulating layer and for supplying the removed toner to said toner suppy means.

10. The developer and cleaning apparatus of claim 9, wherein said removing means comprises a cleaning blade in contact with said insulating layer.

11. The developing and cleaning apparatus of claim 9, wherein said electrostatic image holder is a photosensitive receptor drum.

12. The developer and cleaning apparatus of claim 9, wherein said film member is movable at substantially the same linear speed as said movable electrostatic image holder at least at the point of contact of said film member with said electrostatic image holder when said film member is at said second position.

13. A toner cleaning apparatus for cleaning toner from the surface of a movable electrostatic image holder, comprising:

a flexible endless belt-type film member comprising an insulating layer and a conductive layer inside said insulating layer, said endless film member being rotatably mounted, said film member being positioned so that at least a part thereof faces a surface of said electrostatic image holder;

displacing means coupled to said film member for selectively displacing said film member from a first position whereat insulating layer of said film member is close to but spaced from and facing said electrostatic image holder to a second position whereat at least a surface portion of said insulating layer of said film member faces and is in contact with the surface of said electrostatic image holder;

voltage supply means including an electrode member coupled to said film member for applying a voltage between said electrostatic mage holder and said conductive layer of said film member when said film member is at said second position, said applied voltage being a D.C. voltage whose polarity is opposite to that of toner on the surface of said electrostatic image holder; and said displacing means displacing said film member to said second position when said voltage is applied;

whereby toner from the surface of said image holder is transferred to said insulating layer under the influence of said applied voltage when said film member is at said second position.

14. The toner cleaning apparatus of claim 13, further comprising removing means associated with said film member for removing toner adhering to said insulating layer of said film member.

15. The toner cleaning apparatus of any one of claims 13 or 14, wherein said conductive layer has a resistivity of not less than $10^5$ Ω.cm and not more than $10^{12}$Ω.cm.

16. The toner cleaning apparatus of claims 13 or 14, further comprising charge eliminating means for eliminating the charge on the conductive layer of said film member.

17. The toner cleaning apparatus of any one of claims 13 or 14, further comprising a magnet arranged near a surface portion of said conductive layer of said film member at the position where said film member is closely against said electrostatic image holder.

18. The toner cleaning apparatus of claim 13, further comprising an elastic holding means for holding said endless film member.

19. The toner cleaning apparatus of claim 18, wherein said holding means comprises at least two elastic rollers over which said endless film member is arranged.

20. The toner cleaning apparatus of any one of claims 13 or 14, further comprising a light source for illuminating the surface of said electrostatic image holder arranged near said film member before said film member contacts said image holder.

21. The toner cleaning apparatus of claim 14, wherein said removing means comprises an electrically conductive rubber blade in contact with said insulating layer of said film member.

22. The toner cleaning apparatus of claim 13, further comprising means for applying tension to said endless film member.

23. The toner cleaning apparatus of claim 22, wherein the tension applying means comprises at least two elastic rollers over which said endless film member is arranged.

24. The toner cleaning apparatus of claim 13, wherein said voltage supply means supplies an a.c. voltage superposed on a d.c. voltage to said electrode member.

25. The toner cleaning apparatus of claim 13, wherein said holding means comprises at least two rollers over which said endless film member is arranged, and wherein said voltage supply means includes means for supplying a voltage to at least one of said rollers.

26. The toner cleaning apparatus of claim 13, wherein said film member is movable at substantially the same linear speed as said movable electrostatic image holder at least at the point of contact of said film member with said electrostatic image holder when said film member is at said second position.

* * * * *